US005413189A

United States Patent [19]

Browning et al.

[11] Patent Number: 5,413,189

[45] Date of Patent: May 9, 1995

[54] SOUND ATTENUATING DEVICE AND INSERT

[75] Inventors: James R. Browning, Berea; Gerald A. Carek, Vermillion, both of Ohio

[73] Assignee: J. B. Design, Inc., Berea, Ohio

[21] Appl. No.: 114,156

[22] Filed: Sep. 1, 1993

[51] Int. Cl.[6] ..... F01N 1/08

[52] U.S. Cl. ..... 181/268; 181/265; 181/275; 181/281; 181/282

[58] Field of Search ..... 181/251, 257, 264, 265, 181/266, 268, 274, 275, 281, 282, 235

[56] References Cited

U.S. PATENT DOCUMENTS

| | | | |
|---|---|---|---|
| 981,584 | 1/1911 | Miller | 181/268 |
| 4,424,882 | 1/1984 | Moller | 181/231 |
| 4,643,272 | 2/1987 | Gaffrig | 181/260 |
| 4,809,812 | 3/1989 | Flugger | 181/268 |

*Primary Examiner*—Khanh Dang
*Attorney, Agent, or Firm*—Vickers, Daniels & Young

[57] ABSTRACT

A sound attenuating muffler useful with an internal combustion engine, preferably for marine applications, contains an insert comprising an arrangement of annular sound reflecting surfaces defining an inner chamber into which engine exhaust gases flow in a first direction and one or more directors to divert the axial flow of gases and sound waves in a second direction past these sound reflecting surfaces. As the sound waves are reflected off of these surfaces back into the muffler interior, attenuation of the sound is achieved. The gases exit the muffler to the atmosphere through an outer chamber surrounding the inner chamber. A method of assembling the component parts of the insert is also described.

13 Claims, 4 Drawing Sheets

FIG. 5A
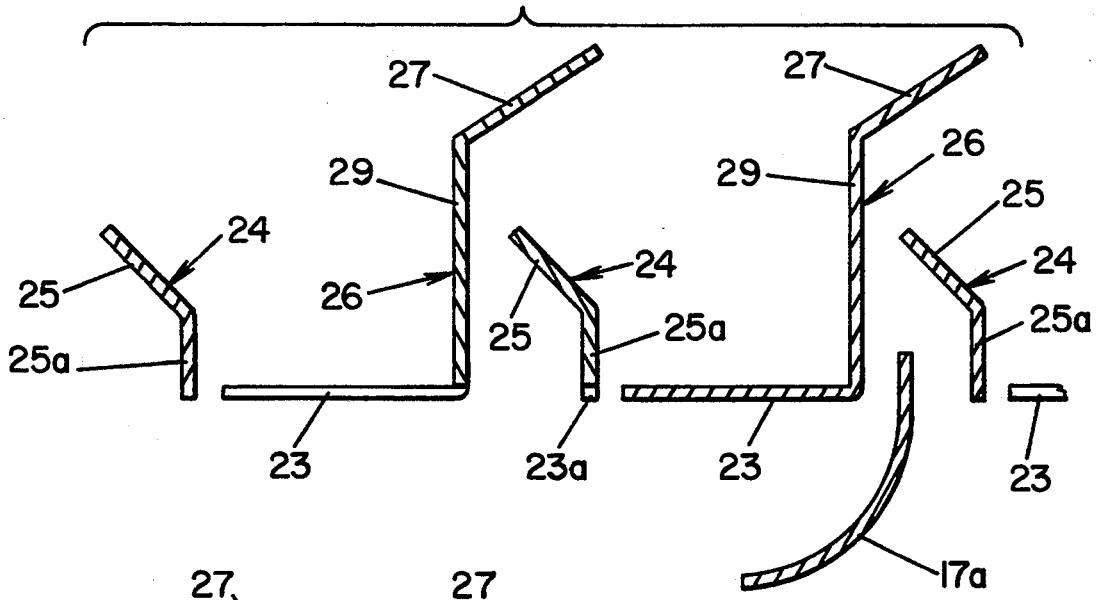
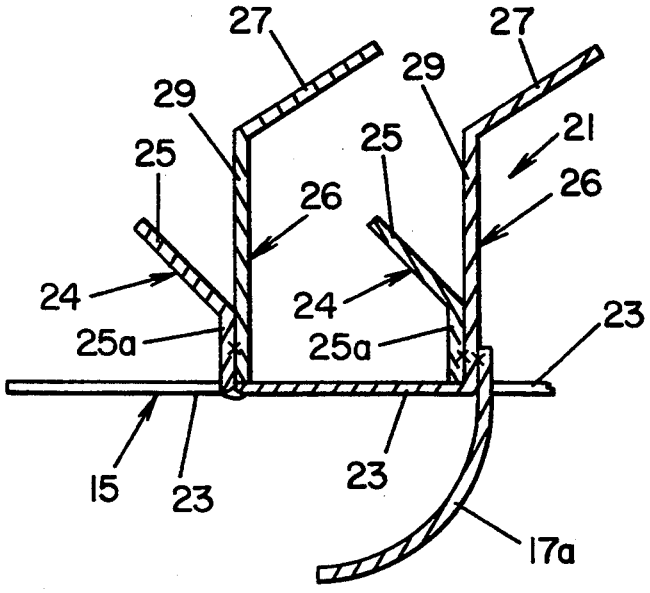
FIG. 5B
FIG. 6A
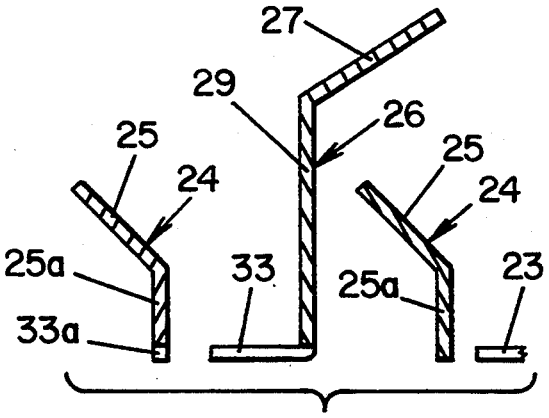
FIG. 6B
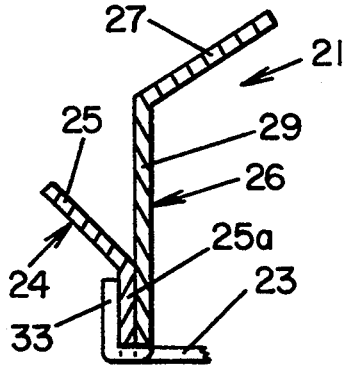

SOUND ATTENUATING DEVICE AND INSERT

BACKGROUND OF INVENTION

This invention relates to mufflers of the sound-modifying type used with internal combustion engines to attenuate engine noise. More specifically, the invention relates to the construction of a muffler containing an insert having one or more means for directing the flow of exhaust gases and a plurality of reflecting surfaces for internal attenuation of sound waves.

Engine noise in an internal combustion engine typically is generated by the sudden expansion of combustion chamber exhaust gases. As the combustion gases are exhausted from each cylinder of the engine, a sound wave front travels at rapid sonic velocities through the exhaust system. This wave front is the boundary between the high pressure exhaust pulse and ambient pressure. When the sound wave front exits the exhaust system, it continues to pass through the air until three dimensional diffusion causes it to eventually dissipate. As the wave front passes an object, an overpressure is created at the surface of the object, and it is this overpressure that is the direct cause of audible and objectionable noise.

Since the inception of the internal combustion engine, efforts have been underway to reduce or muffle the noise caused by the engine. Obviously, considerable noise attenuation or reduction can be achieved in a muffler having dimensions that are large enough to permit three dimensional dissipation of the sound waves within the muffler housing. However, from a practical standpoint, design criteria often dictate that the size of the muffler must be kept as small as possible. Further means of attenuating engine noise include the use of packings and complex baffle systems. Often, these approaches are accompanied by a substantial increase in the back pressure or resistance of the muffler to the free discharge of the combustion gases. The increase in back pressure can result in a decrease in the output horsepower of the engine with a resulting loss of efficiency and fuel economy. Thus, it is clear that a goal of most muffler designs is to achieve maximum attenuation of sound within a muffler system of reasonable proportions while reducing or minimizing back pressure.

Increasingly, the public awareness and objection to environmental problems including "noise pollution" has led to more stringent noise control regulations. At the same time, there is a strong mandate for greater fuel economy and more complete fuel combustion along with smoother and more efficient operation of internal combustion engines. Achieving these seemingly incompatible objectives in a muffler design is a constant challenge.

BRIEF DESCRIPTION OF THE INVENTION

This invention relates to mufflers of a type commonly used to attenuate or reduce the sounds generated by internal combustion engines. More specifically, the invention relates to a muffler having a compact design and containing an insert comprising an arrangement of sound reflectors for providing sound attenuation with minimum back pressure. The muffler can be used with any type of engine but is especially adapted for used on inboard or sterndrive marine engines.

The muffler of this invention, also referred to as a sound attenuating device, comprises an inner chamber and an outer chamber surrounding the inner chamber and radially spaced therefrom. The two chambers are contained within an axially extending housing having an inlet means and outlet means for the passage of the gases of combustion.

The combustion gases flow from the engine through an exhaust pipe to the muffler where they enter the inner chamber through the muffler inlet means. The gases are than redirected by means comprising one or more directors axially spaced from one another within the inner chamber. The gas flow is redirected from a first direction into one or more flow paths generally orthogonal to said first direction whereby said gases pass from the inner chamber into the outer chamber. As the gases flow into the outer chamber, the attendant sound waves are bounced off of reflector means comprising a plurality of annular, preferably metal, acoustical reflector rings axially spaced from one another to provide means comprising open passageways between the inner chamber and the outer chamber. These annular reflector rings generally define the shape of the insert and are maintained in fixed, spaced-apart relationship to one another by suitable means such as spacers to define the overall dimensions of the inner chamber. Each reflector includes at least one and preferably two or more reflective surfaces to repeatedly reflect and attenuate the sound waves as they pass through to the outer chamber. It has been found that the use of a first reflective surface, which forms an angle of 45° or less with respect to the muffler axis when used with a second reflective surface forming an opposite angle of approximately 32° with respect to the said axis, results in a high degree of sound attenuation.

As the exhaust gases and attendant sound waves enter the muffler and progress along the axis of the muffler, a portion of the gases and the sound waves are redirected by each of a plurality of directors spaced axially from one another within the inner chamber. The directors include a generally frusto-conical flow diverter at the downstream end of the inner chamber with the conical portion extending into the chamber toward the inlet. Upstream from this frusto-conical diverter are one or more annular flow directors extending radially in from the annular reflector rings, each one adapted to redirect a portion of the exhaust gases radially outwardly to pass from the inner chamber into the outer chamber. This results in the creation of smaller, finite wave fronts that are generally at right angles to the original wave front moving in the first direction. The smaller wave fronts progress in the radial direction out of the inner chamber into the outer chamber. This causes some three-dimensional diffusion of the sound wave to occur, resulting in a decrease in the overpressure within each of the smaller wave fronts. As previously mentioned, the sound wave is reflected from either of two surfaces which form an angle of 0° to 45° and about 32° with respect to the muffler axis. The portion of the wave front that is reflected from the first surface continues through a series of reflections back toward the center of the muffler in the inner chamber. The portion of the wave front that bypasses the first surface is reflected from the second surface positioned radially outward of said first surface and continues through a series of reflections, with substantially all of the waves returning into the inner chamber. This unique method of redirecting the wave fronts back toward the axis of the muffler while diffusing the gases radially outwardly results in significant sound attenuation while minimizing back pressure buildup.

DESCRIPTION OF THE DRAWINGS

FIGS. 5A and 5B show, respectively, an exploded view and an assembled view, both in cross-section of two adjacent reflector ring assemblies and one gas flow deflector;

FIGS. 6A and 6B show, respectively, in an exploded view and an assembled view, a reflector ring assembly;

DETAILED DESCRIPTION OF THE INVENTION

This invention relates to a muffler of the type commonly used to reduce the sound generated by the operation of an internal combustion engine. The type and nature of the engine generally is not a factor in the teachings of the invention. For example, the muffler could be used with in-line, V6, V8, rotary as well as single-cylinder internal combustion and diesel engines. All such engines would and could benefit from the use of the muffler of the present invention.

More specifically, the invention relates to a muffler which includes an insert comprising a plurality of annular sound reflector rings and one or more gas flow directors. The insert divides the muffler into an inner chamber and an outer chamber. The component parts of said insert are capable of being assembled together in a simple manner to form a plurality of passageways through which combustion gases are caused to flow from the inner chamber into an outer chamber radially surrounding the inner chamber. The sound waves accompanying the gases are reduced in intensity as they are reflected off of the surfaces of the sound reflector rings back into the inner chamber. The angles at which the reflection surfaces are placed relative to the direction of flow of the gases and sound waves result in a high degree of sound attenuation by intercepting the sound waves and redirecting them back into the center of the inner chamber.

Figure 1:
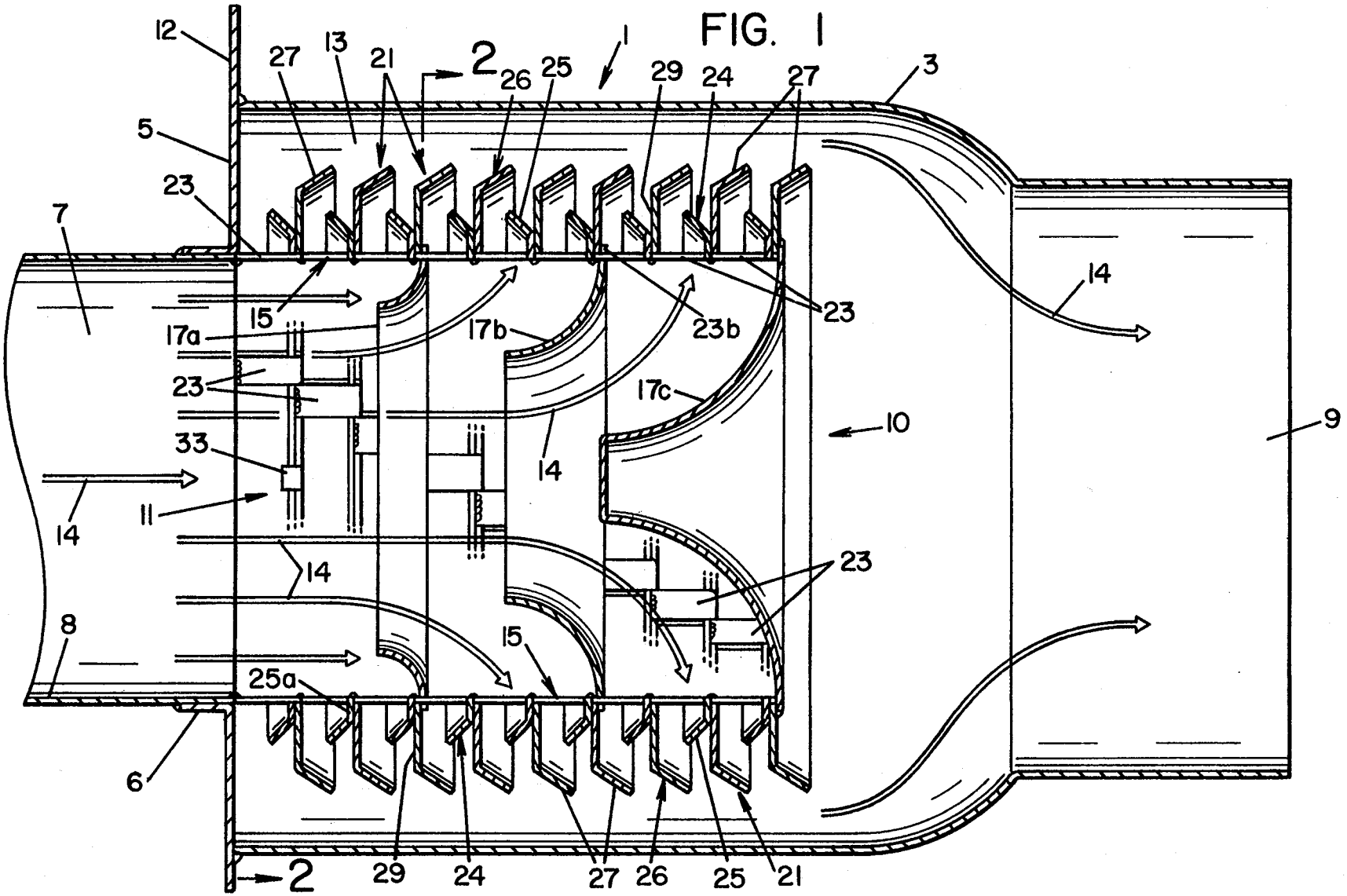
FIG. 1 is a cross sectional view of the muffler of the present invention.
Figure 2:
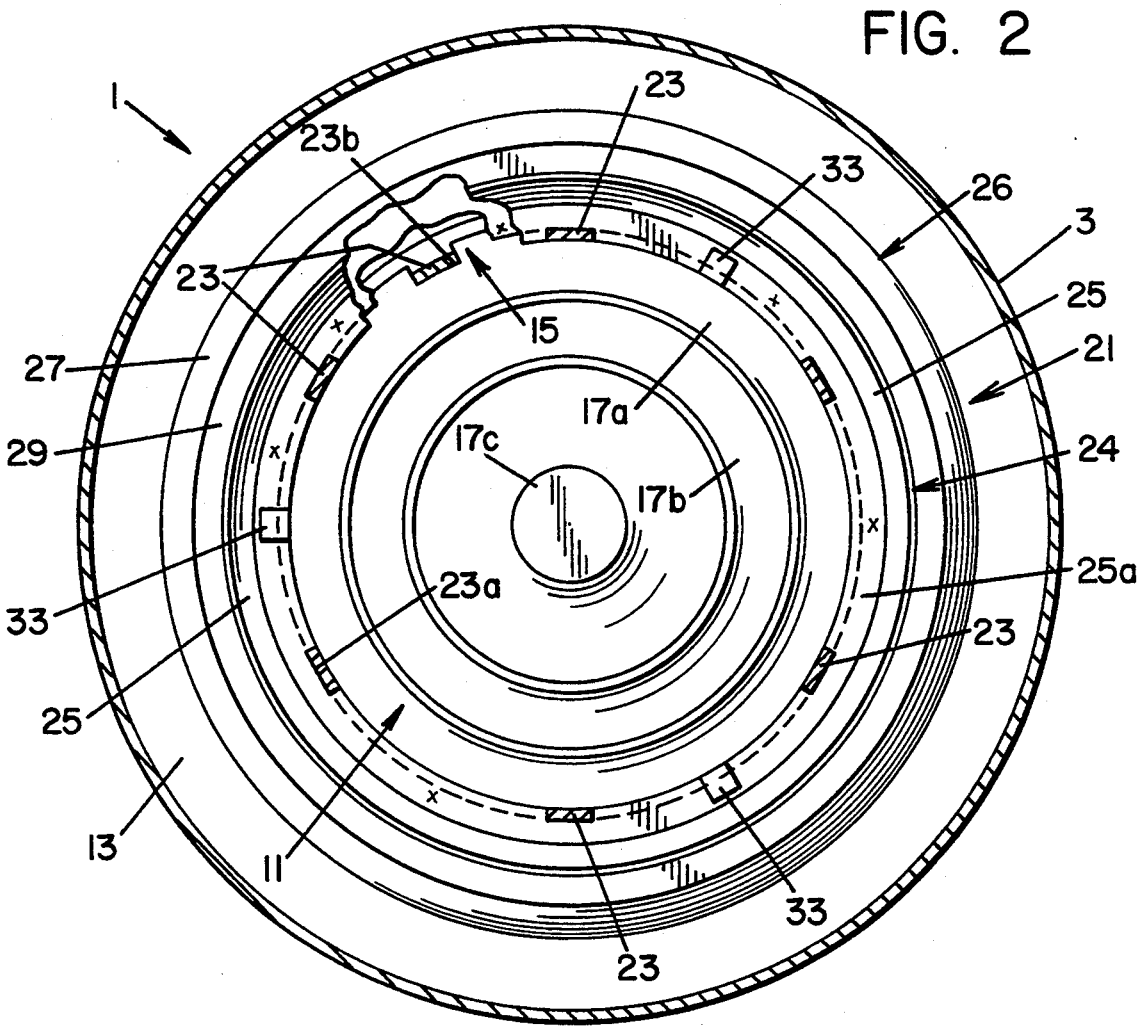
FIG. 2 is a cross sectional view taken along lines 2—2 of FIG. 1.

Referring now to the drawings, FIG. 1 shows a muffler 1 contained within a muffler housing 3. The inlet 7 of the muffler of the present invention is defined by an annular end wall 5 and a flange 6. The flange is adapted to be welded or clamped to an exhaust pipe 8, the exhaust pipe in turn communicating directly with the exhaust manifold of an internal combustion engine. When used on a marine vessel, the end wall may extend radially outwardly to form a second flange 12 adapted to be fastened to the stern of the vessel. At the opposite end of the muffler is an outlet 9 which is adapted to be coupled to a functional or decorative tail pipe (not shown). Depending on the position, use and space requirement and restrictions, the exhaust system may or may not use a tail pipe.

The muffler contains an insert 10 which defines an inner chamber 11 and an outer chamber 13. The insert contains a plurality of openings 15 which allow hot exhaust gases to pass from the inner chamber to the outer chamber and thence to the atmosphere. The inner chamber contains one or more gas flow diverters shown as directors 17*a*, 17*b* and 17*c*. The flow of exhaust gases through the muffler is shown by the arrows 14 in FIG. 1. The directors are used to redirect the gas flow and the sound waves from a first direction into a second radial direction. The directors are positioned and sized so as to distribute the flow of exhaust gases somewhat equally along the axial length of the inner chamber through the flow path openings 15 between the spaced reflector ring assemblies 21. Director 17*a* closest to the inlet is the smallest of the annular directors and is generally in the shape of a curved flange or washer attached to a selected reflector ring. Because the volume of gas flowing in an axial direction is decreased after passing the first director ring, the second annular director 17*b* is larger and has a smaller annular opening than the first director. It likewise redirects a portion of the remaining axially flowing gases into the openings 15 between the reflector rings 21 located between the two directors 17*a* and 17*b*. The remainder of the gases are then redirected by the frusto-conical director 17*c* which closes off the exit end of the inner chamber. As mentioned, the annular directors 17*a* and 17*b* are sized so as to redirect a proportionate volume of gases through the openings 15 of the insert 10 into the outer chamber and are generally concave in cross-section to minimize turbulence as the gas flow is redirected from the axial to the radial direction. The inner chamber is separated from the outer chamber by the insert 10 comprising a series of reflector ring assemblies 21. Each ring assembly is spaced apart from the next adjacent ring assembly by means such as spacers 23. Depending upon the degree of structural rigidity or the size of the muffler and the materials of construction, between 3 and 12 spacers are used to attach each ring to the next adjacent ring. Preferably, the spacers connecting two ring assemblies together are offset circumferentially from the spacers joining the next adjacent ring assembly so as to facilitate the even flow of exhaust gases past the reflector surfaces.

Figure 4:
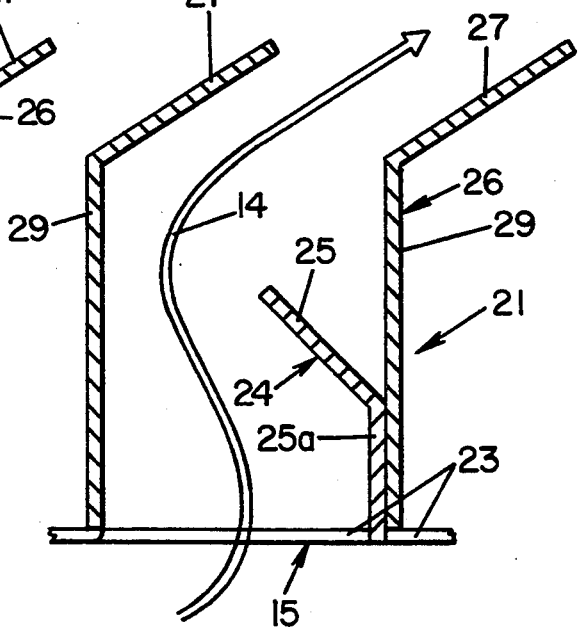
FIG. 4 is a diagram showing the path of the exhaust gases flowing past the acoustical reflectors.

Each ring assembly 21 is comprised of a first reflector element 24 and a second reflector element 26. The first reflector element 24 comprises a reflective surface 25 and a support leg 25*a*. Two sets of notches 23*a* and 33*a* are provided on the inner edge of the support leg 25*a* to engage corresponding spacers 23 and lugs 33 on the second reflector element 26. The reflective surface 25 forms an angle of about 45° or less with respect to the muffler axis. In a preferred embodiment, this first reflective surface extends radially outwardly at an angle of at least 135° with respect to the direction of flow of the gases entering the inner chamber 11. This causes the radially moving gases to be diverted around the reflector surface as shown in FIG. 4.

This first reflector surface extends into the annular space between adjacent ring assemblies a sufficient distance to cause a substantial portion of the sound waves to bounce and be internally reflected, as will be hereinafter described more specifically with reference to FIG. 3. Generally, the first reflective surface should extend a distance of between about 20% and 80%, preferably between about 40% and 60%, of said annular distance.

The second reflector element 26 comprises a reflector surface 27 radially outside of, and inclined in the opposite direction to, reflector surface 25. This causes the exhaust gases to be redirected to flow toward the muffler outlet 9 as they pass into the outer chamber (See FIG. 4) while simultaneously causing the sound waves which had bypassed the first reflector surface 25 to be internally reflected away from the outlet. The angle that the second reflector surface 27 forms with respect to the muffler axis and to the axial direction of flow is preferably between about 25° and 40° and more preferably about 32°. This second surface extends into the opening 15 a sufficient distance so that substantially all of the sound waves which bypass the first surface 25 will strike and be reflected off said second surface.

The second reflector element 26 includes a third reflector surface 29 which is joined to reflector surface 27 as an integral unit. This third reflector surface is preferably, but not necessarily, at right angles to the axis of the muffler.

Figure 3:
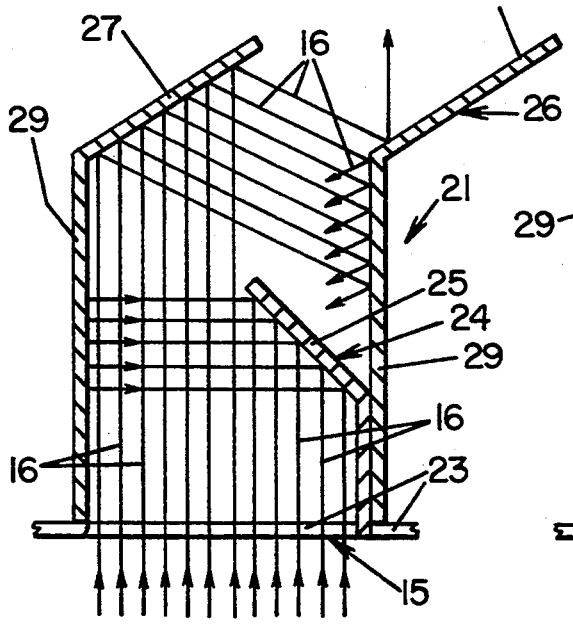
FIG. 3 is a diagram depicting the movement of sound waves as they are reflected off of the surface of the acoustical reflectors shown in FIG. 1.

The effect of the reflector surfaces on the sound waves is shown in FIG. 3. These sound waves are represented by a series of parallel lines and arrows 16. The waves, after having been deflected by the gas flow directors in the inner chamber, move radially in straight lines through the openings 15 between adjacent rings 21. A portion of the waves contact the first reflector 25 which, as previously stated, is at an angle of preferably about 45° with respect to the muffler axis extending in the direction opposite to the axial flow of the gases. These waves are reflected off the first reflector 25 in a generally axial direction where they contact the reflector surface 29, which is positioned generally perpendicular to the muffler axis at right angles to the direction of the sound waves coming from reflector 25. This causes the sound waves to be reflected back to the first reflector surface 25 from where they are reflected back into the interior of the inner chamber. Each deflection of the sound waves causes attenuation or weakening of the sound waves. A portion of the sound waves bypass the first reflector surface 25 and continue radially outward until they contact the second reflector 27. These sound waves are bounced off of the second surface toward third reflector 29, where further reflections against surfaces 25, 27 and 29 cause these sound waves to eventually reflect back into the inner chamber where further attenuation occurs. As the sound is being attenuated, the hot exhaust gases flow freely past the reflector 25 and are redirected by the second reflector 27 toward the rear of the muffler where they exit through the outlet to the atmosphere.

Figures 7, 8:
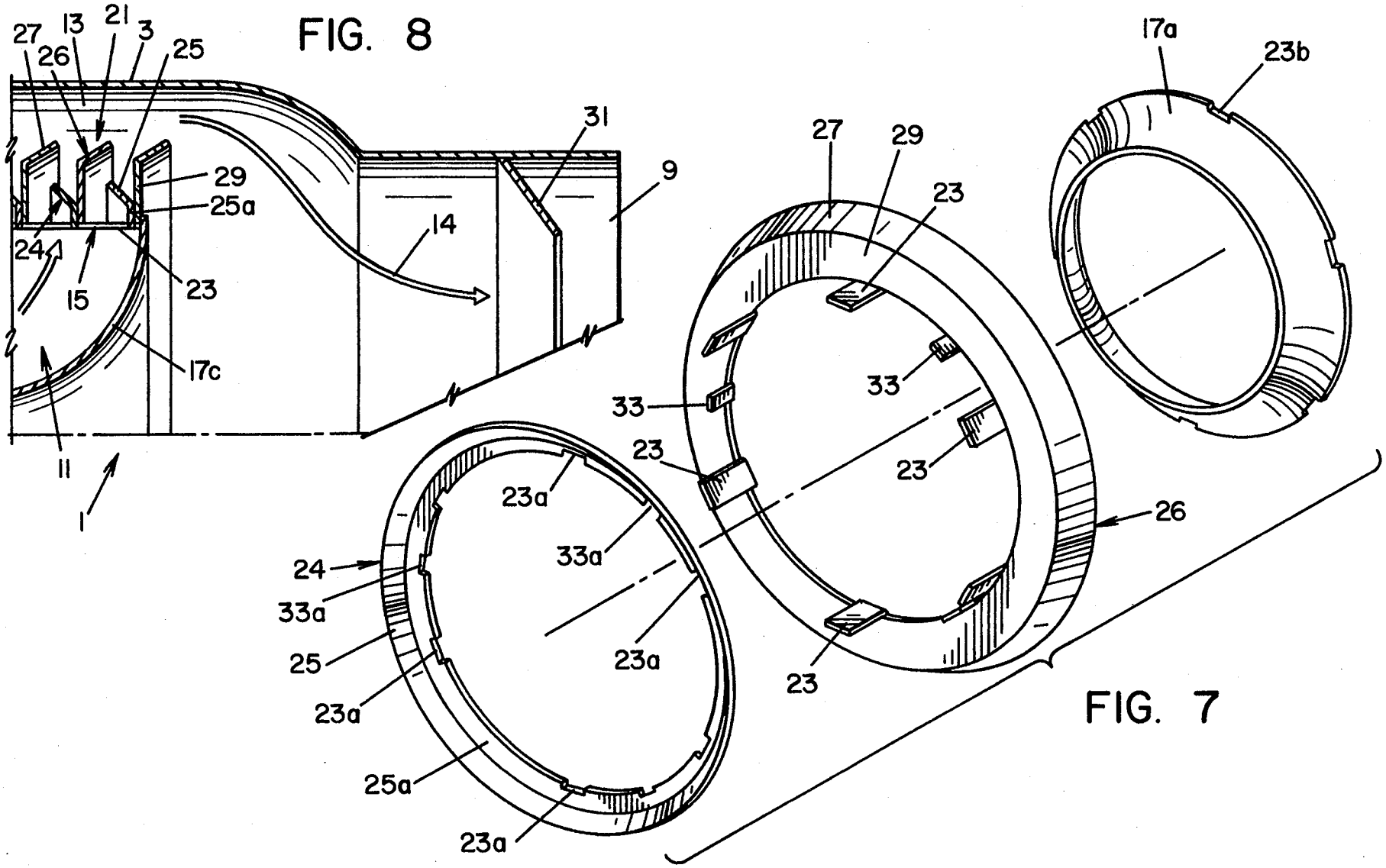
FIG. 7 is an exploded perspective view of the component parts of a hot gas deflector and a reflector ring assembly; and, FIG. 8 shows a modification of the present invention with an additional acoustical reflector positioned in the muffler outlet.

FIGS. 5, 6 and 7 show in a general manner a preferred method of assembling the reflector rings and gas flow directors into the insert 10. FIG. 5A shows in expanded view the component parts of a reflector ring assembly including first reflector element 24 comprising reflector surface 25 and supporting leg 25*a*, and the second reflector element 26 comprising the second and third reflectors 27 and 29. The second element 26 contains spacers 23 and locking lugs 33 (shown in FIGS. 6 and 7) positioned around its inner periphery. The spacers 23 are adapted to engage notches 23*a* in the support leg 25*a* of the first reflector and notches 23*b* in the gas director 17*a*. As shown in FIG. 7, each assembly contains 6 spacers adapted to mate with corresponding notches in the support leg 25*a* and the director 17*a*.

As shown in FIGS. 6A and 6B, three or more locking lugs 33 on reflector element 26 are adapted to mate with the notches 33*a* in the support leg 25*a* of reflector element 24. The locking lugs are then crimped against the reflector 25 to hold the reflector ring assembly 21 together as shown in FIG. 6*b*. Again referring to FIG. 5, a plurality of individual ring assemblies are joined together in spaced apart relationship by spot welding each ring assembly to the ends of the spacers 23 of the next adjacent assembly, said spacers engaged in the respective notches 23*a*. The annular flow director 17*a* can likewise be assembled together with a specific reflector ring, in like manner with the notches 23*b* in the director adapted to mate with corresponding spacers 23. Alternatively, the directors can be joined to the respective reflector rings by other means such as spot welding or brazing.

FIG. 8 shows a further embodiment of the invention in which a sound reflector ring 31 is placed in the outlet 9 of the muffler to further reflect and attenuate sound waves which may have bypassed the reflector surfaces 25, 27 and 29 formed by the individual reflector rings 21. This optional reflector ring must not substantially impede the exhausting combustion gases. Therefore, it would normally not extend radially into the muffler outlet more than approximately 25% of the diameter of the outlet.

This novel muffler and insert of the present invention have been described in terms of a generally circular cross section. It is also understood, however, that the benefits of this invention can likewise be realized with mufflers and inserts having other cross-sectional configurations, such as oval and polygonal.

The materials used to build the muffler of this invention are those normally used for muffler construction and are well known to the industry. Typically, galvanized steel, stainless steel and various alloys having resistance to the high temperatures, moisture and chemicals present in the products of combustion can be used.

Although this muffler and insert have been described in connection with their use in marine applications, they are also useful with obvious modifications on land vehicles, power equipment, recreation vehicles and other applications where a compact, effective sound attenuator for an internal combustion engine is required or desirable. Other obvious modifications can be made in this muffler and insert without departing from the scope of the invention as defined in the claims.

Having thus defined the invention, the following is claimed:

1. In a muffler useful for attenuating the sounds of an internal combustion engine including an axially extending housing having an inlet adapted to be connected to an exhaust pipe in communication with the engine, and an outlet, the improvement comprising: an inner chamber adapted to receive exhaust gases moving in an axial direction, said inner chamber including means for redirecting the flow of gases from the axial direction into a radially outward direction, and a plurality of annular acoustical reflectors axially spaced from one another to form open passageways for the radial flow of exhaust gases from the inner chamber into an outer chamber defined by said housing and said inner chamber, each reflector including at least one sound reflection surface radially outwardly of said inner chamber and extending into each open passageway whereby sound waves are reflected from each of said surfaces to cause attenuation of the sound, each of said sound reflection surfaces forming an angle of 45° or less with respect to the axis of the muffler.

2. The muffler according to claim 1 wherein each reflector includes a second sound reflection surface extending into the open passageway radially outward of said first surface in a direction that is axially opposed to that of the first reflecting surface.

3. The muffler according to claim 2 wherein said second reflection surface forms an angle of about 32° with respect to said muffler axis in the direction opposite to said first reflection surface.

4. In a muffler useful for attenuating the sounds of an internal combustion engine including an axially extending housing having an inlet adapted to be connected to an exhaust pipe in communication with the engine, and an outlet, the improvement comprising: an inner chamber adapted to receive exhaust gases moving in an axial direction, said inner chamber including means for redirecting the flow of gases from the axial direction into a radially outward direction, and a plurality of annular acoustical reflectors axially spaced from one another to form open passageways for the radial flow of exhaust gases from the inner chamber into an outer chamber defined by said housing and said inner chamber, each reflector including at least one sound reflection surface radially outwardly of said inner chamber and extending into each open passageway whereby sound waves are reflected from each of said surfaces to cause attenuation of the sound, each annular acoustical reflector consisting of an annular reflector ring assembly including a first reflection surface forming an angle of about 135° with respect to the axial flow of gases and a second reflection surface spaced from and extending radially outward of said first surface and forming an angle of about 32° with respect to the direction of said axial flow.

5. The muffler according to claim 4 wherein each reflector ring assembly includes at least one additional reflection surface extending outwardly from the inner chamber in a radial direction and joined to said second reflection surface.

6. The muffler according to claim 5 wherein at least one additional annular sound reflection surface is located in proximity to the muffler outlet to reflect at least some sound waves back into the muffler.

7. A sound attenuating device including an insert creating an inner chamber and an outer chamber surrounding the inner chamber and radially spaced therefrom within a housing having inlet and outlet means for the passage of gases of combustion from an internal combustion engine, said insert including flow directing means within the inner chamber for directing the flow of incoming gases and sound waves from a first incoming direction of flow to a second direction orthogonal to the first direction, passageway means for facilitating the flow of gases and sound waves out of the inner chamber and into the outer chamber, and reflection means for repeatedly reflecting sound waves back into the inner chamber, said flow directing means including at least one flow director positioned within said inner chamber, said reflection means for reflecting sound waves comprising a plurality of annular ring assemblies spaced from one another to facilitate the passage of gases from the inner chamber to the outer chamber, each ring assembly comprising a first annular reflection element which includes a first reflection surface for reflecting sound waves away from the direction of the gas flow and a second reflection element which includes a second reflecting surface for reflecting sound waves which bypass the first sound reflection surface, said second reflection element including a third reflection surface generally orthogonal to the first direction of flow for additional reflection of sound waves.

8. The device according to claim 7 wherein said ring assemblies are maintained in spaced-apart relationship by spacer means.

9. The device according to claim 7 wherein the first reflection surface forms an angle up to about 45° with respect to the first, direction of flow and the second reflection surface forms an angle of about 32° in the opposite direction with respect to said first direction of flow.

10. The device of claim 9 wherein the second reflection surface is radially outside of said first reflection surface.

11. A sound attenuating insert for use in a muffler of the type having an inlet means for receiving exhaust from an internal combustion engine in the form of exhaust gases and sound waves passing in a first direction and an outlet means for directing at least said gases in said first direction to atmosphere, said sound attenuating insert comprising: a plurality of passage means for directing said gases in a plurality of annular, outwardly directed flow paths generally orthogonal to said first direction, an annular chamber means around and intermediate said inlet means and said outlet means for receiving said gases passing in said flow paths in said insert, and annular reflectors intersecting each of said flow paths, said reflectors each including means for reflecting said sound waves radially inwardly of said insert whereby said sound waves continuously travel in opposite radial directions in said insert for attenuation of said sound waves and reduced contact of said sound waves with said annular chamber, said reflecting means being an annular metal surface with an angle with respect to said first direction of less than about 45° and means defining an annular exhaust passage for allowing a portion of said sound waves and said gases to pass radially outwardly.

12. A muffler insert as defined in claim 11 including a second annular surface extending into said annular exhaust passage radially outwardly of said first annular surface of said reflecting means, said second annular surface intercepting said sound waves and reflecting them radially inwardly of said insert.

13. A muffler insert as defined in claim 12 wherein said second annular surface is a metal ring with an angle of about 32° with respect to said first direction.

* * * * *